United States Patent [19]

Schenk et al.

[11] Patent Number: 4,816,372

[45] Date of Patent: Mar. 28, 1989

[54] HEAT DEVELOPMENT PROCESS AND COLOR PHOTOGRAPHIC RECORDING MATERIAL SUITABLE FOR THIS PROCESS

[75] Inventors: Günther Schenk, Cologne; Manfred Peters, Leverkusen, both of Fed. Rep. of Germany

[73] Assignee: AGFA-Gevaert Aktiengesellschaft, Leverkusen, Fed. Rep. of Germany

[21] Appl. No.: 95,904

[22] Filed: Sep. 14, 1987

[30] Foreign Application Priority Data

Sep. 26, 1986 [DE] Fed. Rep. of Germany ..... 3632737

[51] Int. Cl.[4] ..... G03C 5/54; G03C 7/26

[52] U.S. Cl. ..... 430/203; 430/218; 430/559; 430/617; 430/619

[58] Field of Search ..... 430/203, 218, 617, 619, 430/559

[56] References Cited

U.S. PATENT DOCUMENTS

| | | | |
|---|---|---|---|
| 3,667,959 | 6/1972 | Bojara et al. | 430/203 |
| 4,347,310 | 8/1982 | Shiga et al. | 430/203 |
| 4,628,021 | 12/1986 | Sawada et al. | 430/203 |
| 4,636,455 | 1/1987 | Aono et al. | 430/203 |

*Primary Examiner*—Richard L. Schilling
*Attorney, Agent, or Firm*—Connolly & Hutz

[57] ABSTRACT

Compounds of the formula I are suitable as thermal development and diffusion promoting agents for the heat development process. With the aid of said compounds higher color transfer densities can be achieved and/or the development time can be shortened.

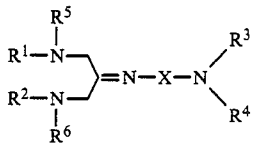

(I)

wherein $X_1$ denotes —$SO_2$— or—CO—;

$R^1$ to $R^4$ denote alkyl, cycloalkyl, aralkyl or aryl;

$R^5$ and $R^6$ denote acyl or a group as defined for $R^1$ to $R^4$; and $R^1$ together with $R^5$, $R^2$ together with $R^6$, $R^3$ together with $R^4$ and/or $R^1$ together with $R^2$ may in each case form a heterocyclic ring containing at least one nitrogen atom.

7 Claims, No Drawings

HEAT DEVELOPMENT PROCESS AND COLOR PHOTOGRAPHIC RECORDING MATERIAL SUITABLE FOR THIS PROCESS

This invention relates to a heat development process in which a colour photographic recording material which has been exposed imagewise and has a layer of binder containing silver halide and at least one colour providing compound mounted on a common layer support and arranged in contact with an image receptor layer which may be an integral part of the recording material or may be arranged on a separate layer support is developed by a heat treatment in the presence of at least one so-called thermal development and diffusion promoting agent.

It is known that colour images can be produced by means of suitable colour photographic recording materials by subjecting them to a heat treatment. Particularly suitable colour providing compounds for this purpose are those which can be incorporated in the layer of a photographic recording material in a non-diffusible form and are capable of releasing a diffusible dye as a result of the development (dye releasing compounds).

The special suitability of such dye releasing compounds is based on the fact that the dyes which are released imagewise can be transferred to special image receptor layers in which they form a brilliant colour image on which no image silver or silver halide is superimposed and which therefore requires no after-treatment. The combination of heat development process and dye diffusion process thus provides an advantageous rapid process for the production of colour images. A suitable recording material for this purpose is described, for example, in DE-A-3 215 485.

According to the said publication, a recording material having a layer which contains a combination of silver halide, silver benzotriazole, a dye releasing compound and guanidine trichloroacetate (base donor) is exposed imagewise and subsequently subjected to a heat treatment in contact with an image receptor sheet so that the dye which is released imagewise is transferred to the image receptor sheet. The production of multicolour images requires the use of several such combinations and the silver halide in each of these combinations is sensitive to a different spectral region of light and according to its spectral sensitivity it is associated with a dye releasing compound which releases a dye of a different colour, in most cases a colour which is complementary to the colour of the light to which the particular silver halide is predominantly sensitive. Such associations may be arranged one above another in different layers.

It is known to carry out the heat development process in the presence of suitable compounds, so-called melt formers or thermal solvents, as described, for example, in Research Disclosure publication 15027 (October 1976), 15108 (November 1976). 17029 (June 1978) or DE-A-33 39 810, EP-A-0 119 615 and EP-A-0 112 512. The above-mentioned compounds are generally solid under normal conditions but melt at the elevated temperature of the heat treatment and by virtue of their dipolar character provide a medium which promotes the development processes. The thermal solvents are predominantly compounds with a protic character. Although the heat treatment may be carried out dry, i.e. without moistening of the recording material or of the image receptor sheets, when the above-mentioned thermal solvents are used, and very good results can be obtained, it is desired to improve the process further so as to be able to reduce the treatment time and/or obtain higher colour transfer densities.

The present invention relates to a heat development process for the production of colour images in which a colour photographic recording material which has been exposed imagewise and which has at least one layer of binder arranged on a layer support and containing light-sensitive silver halide, optionally in combination with a substantially light-insensitive silver salt, and at least one non-diffusible, colour providing compound which is capable of releasing a diffusible dye as a result of development is developed by heat treatment in the presence of a thermal development and diffusion promoting agent, the dye released imagewise from the non-diffusible, colour providing compound being transferred into an image receptor layer which is capable of absorbing diffusible dyes, characterised in that the thermal development and diffusion promoting agent corresponds to the following formula I:

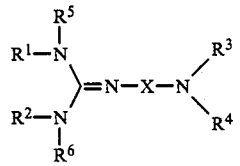

(I)

wherein

X denotes $SO_2$ or CO;

$R^1$–$R^4$ denote alkyl, cycloalkyl, aralkyl or aryl;

$R^5$ and $R^6$ denote acyl or a group denoted by $R^1$–$R^4$; and $R^1$ together with $R^5$; $R^2$ together with $R^6$; $R^3$ together with $R^4$; and/or $R^1$ together with $R^2$ may form a heterocyclic ring containing at least one nitrogen atom.

The invention further relates to a colour photographic recording material which is suitable for the heat development process and contains at least one thermal development and diffusion promoting agent of the type indicated in at least one of its layers.

$R^1$ to $R^6$ may be identical or different; the members of each pair are preferably identical ($R^1$, $R^2$; $R^3$, $R^4$; $R^5$, $R^6$).

An alkyl group denoted by $R^1$ to $R^6$ may be straight chained or branched and may be substituted and preferably contains 1 to 4 carbon atoms. Examples are: Methyl, ethyl, propyl, isopropyl, n-butyl, s-butyl, methoxymethyl, cyclohexylmethyl and hydroxyethyl. The alkyl groups, in particular those denoted by $R^3$ and $R^4$, may each individually contain up to 18 carbon atoms. An example of a cycloalkyl group denoted by $R^1$ to $R^6$ is cyclohexyl. An example of an aralkyl group denoted by $R^1$ to $R^6$ is benzyl. An aryl group denoted by $R^1$ to $R^6$ may be, for example, phenyl, tolyl, methoxyphenyl or N-methyl-N-acetylaminophenyl.

An acyl group denoted by $R^5$ or $R^6$ may be derived from aliphatic or aromatic carboxylic or sulphonic acids or from carbamic or sulphamic acids. Acetyl, methylsulphonyl, phenylsulphonyl, p-methoxyphenylsulphonyl and p-nitrophenyl sulphonyl are examples.

Heterocyclic rings formed by $R^1$ and $R^5$, by $R^2$ and $R^6$, by $R^3$ and $R^4$ and/or by $R^1$ and $R^2$ are preferably 5-membered or 6-membered and have at least one nitrogen atom and optionally also other heteroatoms. A heterocyclic ring formed by $R^1$ and $R^2$ together has at least two nitrogen atoms. Examples of such heterocyclic rings are: Pyrrolidine, piperidine, morpholine, imidazolidine and hexahydropyrimidine.

Under the conditions of heat development, the thermal development and diffusion promoting agents according to the invention (the acronym TDDA will be used below) evidently act as solvating medium for the reactions such as development of the silver halide or of the organic silver salt under the influence of a reducing agent, release of the diffusible dyes from the colour providing compounds and diffusion of the dyes into an image receptor layer. The solvent properties of the TDDA according to the invention may be deliberately steered in the direction of a more hydrophilic or more hydrophobic character by suitable variation of the substituents $R^1$ to $R^6$, in particular the substituents $R^1$ and $R^2$.

Below are given suitable examples of the thermal development and diffusion-promoting agents (TDDA) according to the invention:

1

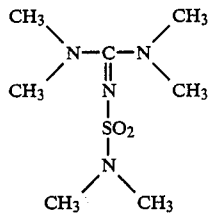

2

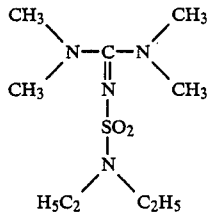

3

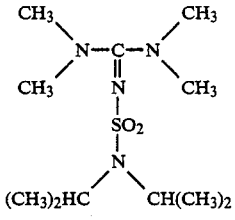

4

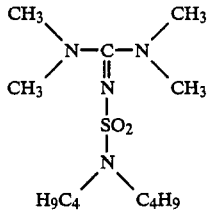

5

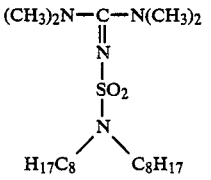

-continued

6)

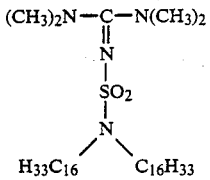

7

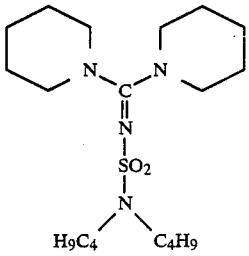

8

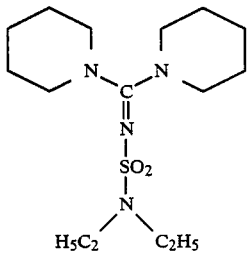

9

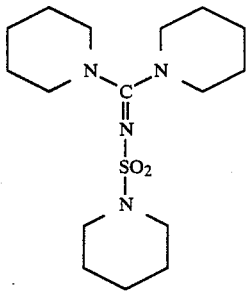

10

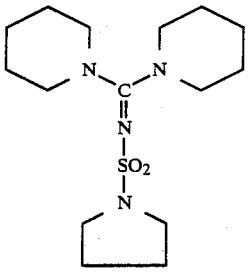

11

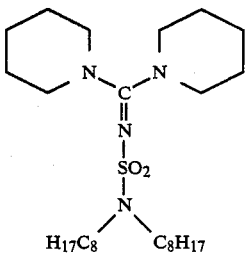

-continued

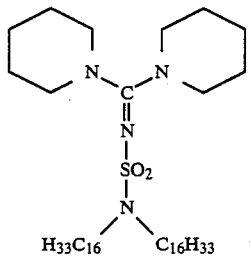

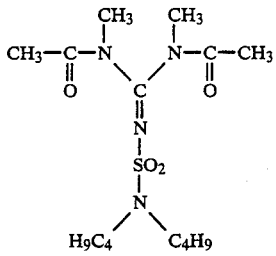

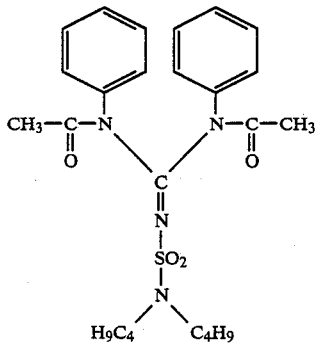

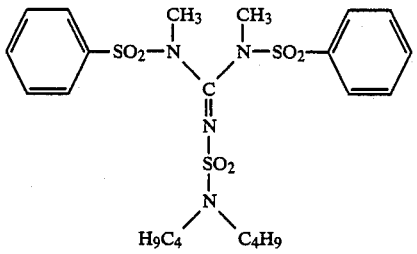

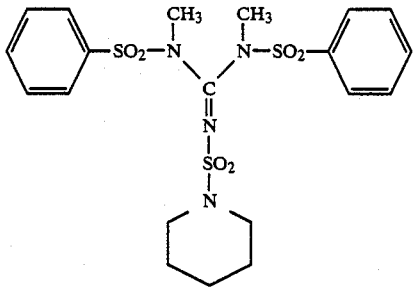

-continued

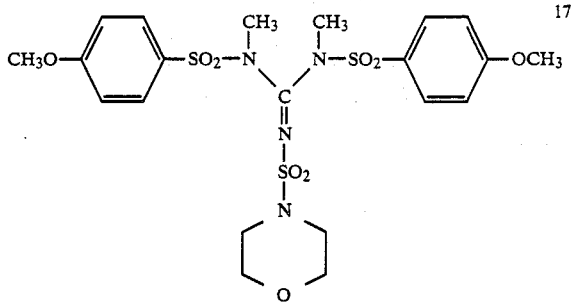

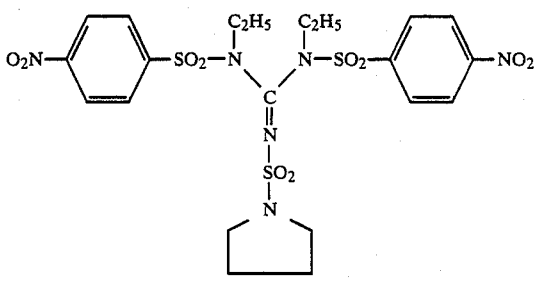

Methods of obtaining guanidyl sulphamides and their precursors are known.

Compounds according to the invention corresponding to formula I are best prepared in accordance with the following reaction scheme:

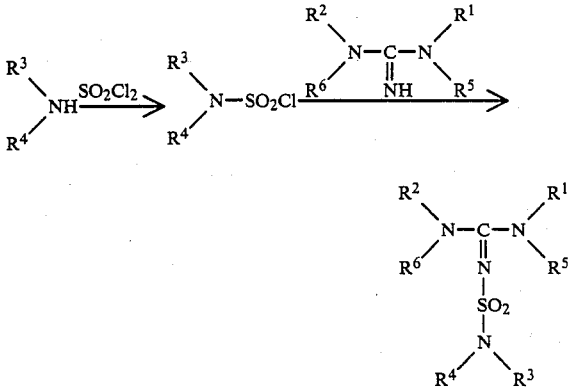

Methods of synthesizing compounds TDDA-4 and TDDA-1 are described below by way of example.

TDDA-4

(1) N,N-Di-n-butyl-sulphamic acid chloride (Compound A) 129 g (1.0 mol) of di-n-butylamine were slowly added dropwise within 5 hours to 135 g (1.0 mol) of sulphuryl chloride with vigorous stirring under conditions of ice cooling. Stirring was then continued for a further 5 hours at 90° C. Ether was added with stirring after the reaction mixture had cooled, and the precipitate formed was separated by suction filtration. The ethereal phase was washed once with water, once with concentrated sodium bicarbonate solution and again with water and dehydrated over sodium sulphate and concentrated by evaporation on a rotary evaporator. The oil obtained was distilled under vacuum and yielded 60 g of Compound A ($bp_{1\ mm}$110°–112° C.).

(2) 64.6 g (0.56 mol) of tetramethylguanidine were dissolved in 500 ml of anhydrous methylene chloride. 50 g (0.23 mol) of compound A dissolved in 120 ml of anhydrous methylene chloride were added dropwise at room temperature within 3 hours. Stirring was then continued for a further 3 hours at room temperature and the reaction mixture was washed several times with water (until neutral), clarified with 10 g of Fuller's Earth, dehydrated with sodium sulphate and suction filtered and the mother liquor was concentrated by evaporation. 55 g of virtually DC-pure TDDA-4 were obtained in the form of an oil.

TDDA-1

11.5 g (0.1 mol) of Tetramethylguanidine were dissolved in 100 ml of methylene chloride and 14.4 g (0.1 mol) of dimethylsulphamic acid chloride dissolved in 50 ml of methylene chloride were added dropwise at room temperature with cooling. Stirring was then continued for one hour and the reaction mixture was concentrated by evaporation. A yellow paste was left as residue. When stirred up with 50 ml of petroleum ether and suction filtered, it yielded a solid hydrochloric acid salt having a melting point of 205° C. This salt was dissolved in water, adjusted to pH=7 with sodium bicarbonate solution and extracted with methylene chloride. The methylene chloride phase was dried and concentrated by equation. 6 g of a white, solid substance melting at 97° C. were obtained.

TDDA-3

6.9 g (0.06 mol) of Tetramethylguanine were dissolved in 50 ml of methylene chloride. A solution of 6.4 g (0.03 mol) of N,N-diisopropylsulphamic acid chloride in 25 ml of methylene chloride was added dropwise at room temperature and the reaction mixture was stirred for one hour. It was then washed with water until neutral. The methylene chloride phase was dehydrated ($Na_2SO_4$) and concentrated by evaporation.

Yield: 9.0 g.

The TDDAs of the aprotic type used according to the invention are preferably liquid under normal conditions (in this respect they differ from the known thermal solvents, which are solid at normal temperature) and are in most cases readily soluble in water so that they may be added directly, either in their undiluted form or as aqueous solutions, to the casting solutions for light-sensitive or light-insensitive layers. TDDAs which are insoluble in water may be introduced into the casting solutions in the form of dispersions. These may be dispersions of pure substances or dispersions of solutions of the pure substances in a high boiling organic solvent (oil former).

The quantity used may vary within a wide range and depends inter alia on whether the compounds are to be distributed over several or all of the layers of the recording material according to the invention or to be concentrated in one particular layer. The quantity to be used per square metre also depends, of course, on the quantity of binder used. The correct concentration can easily be determined by simple, routine tests. The concentration may vary from 2 to 100% by weight, based on the binder, but is preferably in the region of 20 to 50% by weight. Overdosing with TDDA generally results in excessive colour fogging ($D_{min}$).

A colour photographic recording material suitable for carrying out the heat development process according to the invention contains at least one layer of binder on a dimensionally stable layer support, which binder contains a light-sensitive silver halide, optionally in combination with a substantially light-insensitive silver salt, and a non-diffusible colour providing compound which is capable of yielding a diffusible dye by heat development. In addition, the colour photographic recording material contains one or more of the thermal development and diffusion promoting agents (TTDA) in one of its layers.

An essential constituent of the thermally developable recording material according to the present invention is the silver halide, which may consist of silver chloride, silver bromide, silver iodide or mixtures thereof and may have a particle size in the range of from 0.01 to 2.0 μm, preferably from 0.1 to 1.0 μm. The silver halide may be present in a non-sensitized form or it may be chemically and/or spectrally sensitized by suitable additives.

The quantity of light-sensitive silver halide may be from 0.01 to 2.0 g per $m^2$ in each layer, the particular quantity lying mainly at the lower end of this range in some embodiments owing to its catalytic function (as exposed silver halide).

The substantially light-sensitive silver salt may consist, for example, of a silver salt which is comparatively stable in the presence of light, e.g. an organic silver salt. Suitable examples include the silver salts of aliphatic and aromatic carboxylic acids and the silver salts of heterocyclic compounds containing nitrogen as well as silver salts of organic mercapto compounds.

The following are preferred examples of silver salts of aliphatic carboxylic acids: Silver behenate, silver stearate, silver oleate, silver laurate, silver caprate, silver myristate, silver palmitate. silver maleate, silver fumarate, silver tartrate, silver furoate, silver linolate, silver adipate, silver sebacate, silver succinate, silver acetate and silver butyrate.

The carboxylic acids on which these silver salts are based may be substituted, for example with halogen atoms, hydroxyl groups or thioether groups.

The following are examples of silver salts of aromatic carboxylic acids and of other compounds containing carboxyl groups: Silver benzoate, silver 3,5-dihydroxybenzoate, silver o-methylbenzoate, silver m-methylbenzoate, silver p-methylbenzoate, silver 2,4-dichlorobenzoate, silver acetamidobenzoate, silver gallate, silver tannate, silver phthalate, silver terephthalate, silver salicylate, silver phenyl acetate, silver pyromellitate, silver salts of 3-carboxymethyl-4-methyl-4-thiazoline-2-thione and similar heterocyclic compounds. Silver salts of organic mercaptans are also suitable, e.g. the silver salts of 3-mercapto-4-phenyl-1,2,4-triazole, 2-mercaptobenzimidazole, 2-mercaptobenzothiazole, 2-mercaptobenzoxazole, 2-mercaptooxadiazole and mercaptotriazine; also, thioglycollic acid and the silver salts of dithiocarboxylic acids, e.g. the silver salt of dithioacetic acid.

Silver salts of compounds containing an imino group are also suitable. Preferred examples include the silver salts of benzotriazole and of its derivatives, e.g. the silver salts of alkyl- and/or halogen-substituted benzotriazoles such as the silver salts of methylbenzotriazole and of 5-chlorobenzothiazole, and the silver salts of 1,2,4-triazole, 1-H-tetrazole, carbazole and saccharin and the silver salts of imidazole and derivatives thereof.

The quantity of substantially light-insensitive silver salt to be applied according to the present invention is in the range of from 0.05 to 5 g per $m^2$ in each layer. The substantially light-insensitive silver salt and the light-sensitive silver halide may be present side by side as separate particles or they may be present in a combined form which may be produced, for example, by treating a substantially light-insensitive silver salt in the presence of halide ions so that light-sensitive centres of light-sensitive silver halide form on the surface of the particles of the substantially light-insensitive silver salt by double conversion; see US-A-3 457 075.

The substantially light-insensitive silver salt serves as reservoir of metal ions which are reduced to elementary silver under the catalytic influence of the imagewise exposed silver halide when heat development takes place in the presence of a reducing agent and at the same time serve as oxidizing agent (for the reducing agent present).

Another essential constituent of the recording material according to the invention is a non-diffusible, colour providing compound which is capable of releasing a diffusible dye as a result of a redox reaction taking place in the process of development. This compound will hereinafter be referred to as dye releasing compound.

The dye releasing compounds used according to the invention may be any of numerous types of compounds which are all distinguished by a connecting member which is redox dependent in the strength of its bond and connects a dye residue to a carrier group which contains a ballast group.

See in this connection a summary of this field in Angew. Chem. Int. Ed. Engl. 22 (1983), 191–209, in which the most important of the known systems are described.

Particularly advantageous redox active dye releasing compounds are those corresponding to the formula

BALLAST - REDOX - DYE in which

BALLAST denotes a ballast residue

REDOX denotes a redox active group, i.e. a group which is capable of being oxidized or reduced under the conditions of alkaline development and which, depending on whether it is present in the oxidized or the reduced state, is capable of undergoing to varying extents an elimination reaction, a nucleophilic displacement reaction, hydrolysis or some other decomposition reaction which results in the DYE being split off, and DYE denotes the residue of a diffusible dye, e.g. of a yellow, magenta or cyan dye, or the residue of a dye precursor.

Ballast residues are residues which enable the dye releasing compounds according to the invention to be incorporated in a diffusion-fast form in the hydrophilic colloids commonly used in photographic materials. They are preferably organic residues generally containing straight chained or branched aliphatic groups with generally 8 to 20 carbon atoms and optionally also carbocyclic or heterocyclic, optionally aromatic groups. These residues are attached to the remainder of the molecule either directly or indirectly, e.g. by way of one of the following groups: NHCO; $NHSO_2$; NR in which R denotes hydrogen or alkyl: O or S. The ballast residue may in addition contain water-solubilizing groups such as sulpho groups or carboxyl groups, and these may also be present in an anionic form. Since the diffusion properties depend on the molecular size of the whole compound used, it is sufficient in certain cases, for example if the molecule as a whole is large enough, to use relatively short chained residues as ballast residues.

Redox-active carrier residues having the structure BALLAST-REDOX- and appropriate dye releasing compound are known in a wide variety of forms. A detailed description may be omitted here but reference may be made to the above mentioned survey in Angew. Chem. Chem. Int. Ed. Engl. 22 (1983) 191–209.

Some examples of redox-active carrier residues from which a dye residue is split off as a result of imagewise oxidation or reduction are given here purely for illustration:

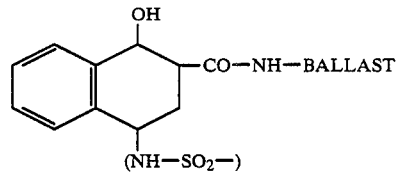

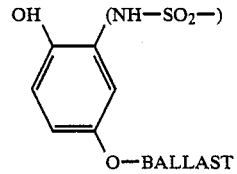

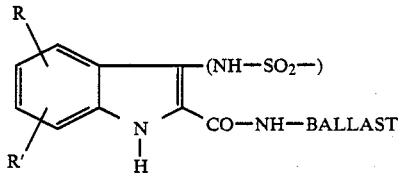

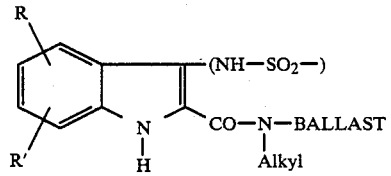

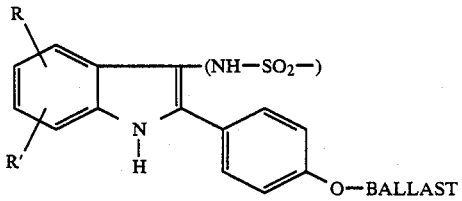

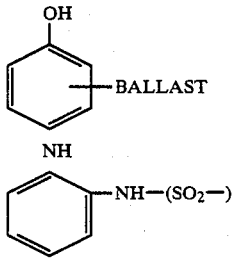

-continued

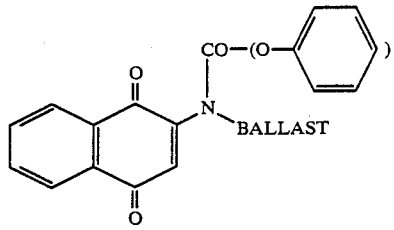

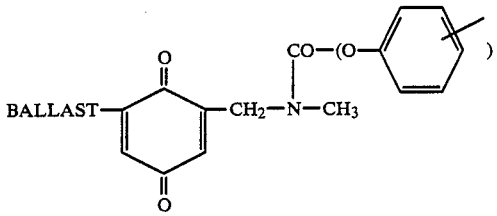

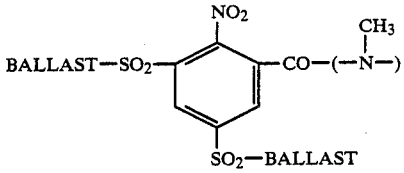

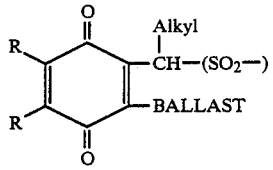

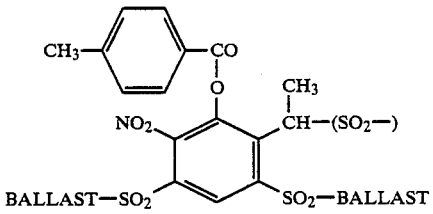

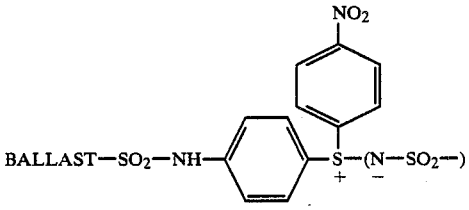

The groups in brackets are functional groups of the dye residue and are separated together with this dye residue from the remaining part of the carrier residue. The functional group may be a substituent which may have a direct influence on the absorption properties and possibly also complex forming properties of the released dye. On the other hand, the functional group may be separated from the chromophore of the dye by an intermediate member or connecting link. Lastly, the functional group may be of some importance together with the intermediate member for the diffusion and mordanting characteristics of the released dye. Examples of suitable intermediate members include alkylene and arylene groups.

The dye residues may be residues from any classes of dyes, provided they are sufficiently diffusible to be able to diffuse from the light-sensitive layer of the light-sensitive material into an image receptor layer. The dye residues may carry one or more alkali solubilizing groups for this purpose. Suitable alkali solubilizing groups include inter alia carboxyl groups, sulpho groups, sulphonamide groups and aromatic hydroxyl groups. Such alkali solubilizing groups may be preformed in the dye releasing compounds or they may result from the separation of the dye residue from the carrier residue which carries the ballast groups. The following are suitable dyes: Azo dyes, azomethine dyes, anthraquinone dyes, phthalocyanine dyes, indigoid dyes and triphenylmethane dyes, including dyes which are in the form of complexes with metal ions or capable of forming such complexes.

The residues of dye precursors are residues of compounds which are converted into dyes in the course of photographic processing, in particular under the conditions of heat development, either by oxidation or by coupling or by complex formation or exposure of an auxochromic group in a chromophoric system, for example by saponification. Dye precursors of this kind may be leuco dyes, couplers or dyes which are converted into other dyes in the course of processing. Where a distinction between dye residues and the residues of dye precursors is not important, the latter will also be referred to as dye residues.

Suitable dye releasing compounds have been described, for example, in the following: US-A-3 227 550, US-A-3 443 939, US-A-3 443 940, DE-A-1 930 215, DE-A-2 242 762, DE-A-2 402 900, DE-A-2 406 664, DE-A-2 505 248, DE-A-2 543 902, DE-A-2 613 005, DE-A-2 645 656, DE-A-2 809 716, DE-A-2 823 159, BE-A-861 241, EP-A-0 004 399, EP-A-0 004 400, DE-A-3 008 588, DE-A-3 014 669 and GB-A-8 012 242.

In some embodiments of the heat development process according to the invention the dye releasing compounds may be present in an oxidizable form or capable of coupling whereas in others they may be present in a reducible form. When a conventional negatively operating silver halide emulsion is used, either a negative or a positive copy of the original is obtained, depending on whether the dye is released from the oxidized or the reduced form of the dye releasing compound. Either positive or negative images may therefore be obtained as required by suitable choice of the dye releasing systems.

Oxidizable dye releasing compounds which are particularly suitable for the heat developable recording materials according to the invention are described, for example, in DE-A-2 242 762, DE-A-2 505 248, DE-A-2 613 005, DE-A-2 645 656 and GB-A-8 012 242.

If the dye releasing compound is oxidizable then it constitutes a reducing agent which is oxidized by the imagewise exposed silver halide or by the substantially light-insensitive silver salt under the catalytic influence of the imagewise exposed silver halide, either directly or indirectly with the aid of electron transfer agents. An imagewise differentiation is obtained as regards the capacity to release the diffusible dye. If, on the other hand, the dye releasing compound is reducible, then it is advantageously used in combination with a reducing agent present in a limited quantity, a so-called electron donor compound or an electron donor precursor compound which in this case is present in the same layer of binder as the dye releasing compound, the light-sensitive silver halide and possibly the substantially light-insensitive silver salt. The presence of electron transfer agents may also be advantageous when reducible dye releasing compounds are used in combination with electron donor compounds.

One example of a recording material according to the, invention which is suitable for the production of positive colour images from positive originals by means of negatively operating silver halide emulsions contains reducible dye releasing compounds which contain a carrier residue corresponding to the following formula:

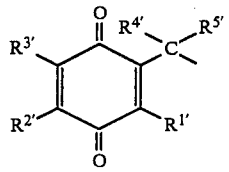

"Carquin"

wherein $R^{1'}$ denotes alkyl or aryl;

$R^{2'}$ denotes alkyl, aryl or a group which together with $R^{3'}$ completes a condensed ring;

$R^{3'}$ denotes hydrogen, alkyl, aryl, hydroxyl, halogen such as chlorine or bromine, amino, alkylamino, dialkylamino including cyclic amino groups (such as piperidino, morpholino), acylamino, alkylthio, alkoxy, aroxy, sulpho or a group which together with $R^{2'}$ completes a condensed ring;

$R^{4'}$ denotes alkyl and $R^{5'}$ denotes alkyl or, preferably, hydrogen and at least one of the groups $R^{1'}$ to $R^{4'}$ contains a ballast residue.

Dye releasing compounds of this kind and others which are also suitable for the purpose of the present invention are described, for example, in De-A-2 809 716, EP-A-0 004 399, DE-A-3 008 588 and DE-A-3 014 669.

The electron donor compound used in combination with a reducible dye releasing compound serves as reducing agent for the silver halide, the substantially light-insensitive silver salt and the dye releasing compound. Since the substantially light-insensitive silver salt and the dye releasing compound compete with each other for the oxidation of the electron donor compound but the former is superior to the latter in this reaction, at least in the presence of exposed silver halide, the silver halide determines, according to its previous imagewise exposure, in which areas of the image the dye releasing compound will be converted into its reduced form by the electron donor compound.

Under the conditions of development, in the present case when the imagewise exposed colour photographic recording material is heated, the electron donor compound which is present in limited quantities is oxidized by the substantially light-insensitive silver salt and the light-sensitive silver halide under the catalytic influence of the latent image nuclei produced in the silver halide by exposure, this oxidation depending on the extent to which exposure has taken place, and the electron donor compound thus oxidized is therefore no longer available for a reaction with the dye releasing compound. An imagewise distribution of unused electron donor compound therefore results.

Non-diffusible or only slightly diffusible derivatives of hydroquinone, of benzisoxazolone, of p-aminophenol and of ascorbic acid (e.g. ascorbyl palmitate) are examples of compounds which have been described as electron donor compounds (DE-A-2 809 716).

Other examples of electron donor compounds are disclosed in DE-A-2 947 425, DE-A-3 006 268, DE-A-3 130 842, DE-A-3 144 037, DE-A-3 217 877, EP-A-0 124 915 and Research Disclosure 24 305 (July 1984). It has been shown that the said electron donor compounds satisfy the requirements under the conditions of heat development and are therefore suitable for use as electron donor compounds for the purpose of the present invention.

Particularly suitable are those electron donor compounds which are formed from their precursor compounds in the layer under the conditions of heat development, i.e. electron donor compounds which prior to development are present in the photographic material in a masked form in which they are virtually inactive. The initially inactive electron donor compounds are then converted into their active form under the conditions of heat development, for example by the hydrolytic removal of certain protective groups. For the present purpose, these electron donor precursor compounds are also regarded as electron donor compounds.

The essential constituents mentioned above of the recording material used for the process according to the invention, namely the light-sensitive silver halide, the substantially light-insensitive, reducible silver salt optionally present and the dye releasing compound optionally used in combination with an electron donor compound, are dispersed side by side in a binder which may be either a hydrophobic or a hydrophilic binder although the latter is preferred. The binder preferably used is gelatine but this may be partly or completely replaced by other natural or synthetic binders. Polyurethanes, for example, are found to be suitable binders, optionally as mixtures with gelatine as described, for example, in DE-A-3 530 156.

For the production of monochrome colour images, one or more dye releasing compounds which release dyes of a particular colour are present in the light-sensitive layer of binder in association with the light-sensitive silver halide and optionally also with the light-insensitive silver salt. The colour finally obtained may result from a mixture of several dyes. It is thereby possible to produce black-and-white images by accurately adjusting the mixture of several dye releasing compounds producing dyes of different colours. For the production of multicolour images, the colour photographic recording material used for the process according to the invention contains several, i.e. generally three associations of dye releasing compounds with silver halides which are sensitized to different regions of the spectrum in each association, the absorption range of the dye released from the dye releasing compound preferably corresponding substantially to the range of spectral sensitivity of the associated silver halide. The various associations of dye releasing compounds with silver halide may be accommodated in different layers of binder in the colour photographic recording material and these different layers of binder are preferably separated by separating layers of a water-permeable binder such as gelatine which mainly serve to separate the various associations from one another to counteract falsification of the colours. In such an arrangement, the colour photographic recording material used in the process according to the invention contains, for example, a light-sensitive layer of binder in which the silver halide is predominantly sensitive to red as a result of spectral sensitization, another light-sensitive layer of binder in which the silver halide has been rendered predominantly green-sensitive by spectral sensitization and a third layer of binder in which the silver halide is predominantly blue-sensitive either as a result of spectral sensitization or due to its intrinsic sensitivity. The electron donor compounds optionally present in the three light-sensitive layers may be identical or different.

Each of the above-mentioned associations of light-sensitive silver halide, substantially light-insensitive silver salt (if present) and dye releasing compound may be used in the form of a so-called complex coacervate.

A complex coacervate is a form of dispersion in which a mixture of the main constituents is enclosed in a common envelope of hardened binder. Dispersions of this kind are referred to as packet emulsions and are obtained by complex coacervation.

The term "complex coacervation" is used to denote the occurrence of two phases when an aqueous solution of a polycationic colloid is mixed with a polyanionic colloid, namely a concentrated colloid phase (hereinafter referred to as complex coacervate) and a dilute colloid phase (hereinafter referred to as equilibrium solution), which are formed as a result of electric interaction. The complex coacervate separates from the equilibrium solution in the form of droplets and appears as a white cloudiness. It is generally assumed that when complex coacervation is carried out in the presence of a solid substance such as a silver halide or in the presence of fine oil droplets, the complex coacervate encloses the solid substance or the droplets in the interior of colloid particles. This results in a dispersion of coacervate particles in which the solid substance (in the present case the light-sensitive silver halide and optionally the substantially/light-insensitive silver salt) and the oily droplets of a solution of the organic constituents (in the present case the dye releasing compound and optionally other auxiliary substances) are enclosed. The material is subsequently hardened with a hardener so that the original form of the particles is not destroyed in the subsequent stages of preparation of the photographic material,such as preparation of the casting solution and application of the coating. A good quality packet emulsion is obtained if the dispersion is cooled to a temperature of 25° C. or below, preferably 10° C. or below before hardening.

Methods for the preparation of a packet emulsion in which a colour producing substance is incorporated by complex coacervation are described, for example, in US-A-3 276 869 and US-A-3 396 026.

The use of packet emulsions enables several emulsion components differing in their spectral sensitivity, including the dye releasing compounds, to be incorporated in a single layer of binder without the spectral associations being lost and consequently without falsification of colour. This is possible because the extent to which a dye is released from the dye releasing compound which is present in the same coacervate particles (packet) as a given silver halide is determined almost entirely by the amount of exposure of the silver halide particle. The use of packet emulsions thus enables a blue-sensitive, a green-sensitive and a red-sensitive silver halide emulsion, optionally together with an additional, substantially light-insensitive silver salt, and the corresponding spectrally associated dye releasing compounds to be accommodated in the same layer of binder without any risk of serious colour falsification.

The colour photographic recording material used in the process according to the invention may contain other constituents and auxiliary agents in addition to the constituents already mentioned above, for example substances required for the heat treatment and the concomitant transfer of colour. These additional constituents or auxiliary substances may be contained in a light-sensitive layer or in a light-insensitive layer.

Auxiliary developers are examples of such auxiliary substances. These auxiliary developers generally have developing properties for exposed silver halide. In the present case, they mainly promote the reactions taking place between the exposed silver salt (silver salt in the presence of exposed silver halide) and the reducing agent. If an oxidizable dye releasing compound is used then the said reducing agent is identical to the latter but if a reducible dye releasing compound is used then the reducing agent reacts with the dye releasing compound. Since these reactions consist mainly in a transfer of electrons, the auxiliary developers are also known as electron transfer agents (ETA). Examples of suitable auxiliary developers include hydroquinone, pyrocatechol, pyrogallol, hydroxylamine, ascorbic acid, 1-phenyl-3-pyrazolidone and derivatives thereof. Since the auxiliary developers carry out a catalytic function, they need not be present in stoichiometric quantities. It is generally sufficient if the layer contains up to half mol of such an auxiliary developer per mol of dye releasing compound. These auxiliary developers may be incorporated in the layer for example by adding them from solutions in water-soluble solvents or by adding them in the form of aqueous dispersions which have been obtained with the aid of oil formers.

Other auxiliary substances include, for example, basic substances or compounds capable of yielding basic substances under the influence of the heat treatment. These include, for example, sodium hydroxide, potassium hydroxide, calcium hydroxide, sodium carbonate, sodium acetate and organic bases, in particular amines such as alkylamines, pyrrolidine, piperidine, amidine, guanidine and salts thereof, in particular salts of aliphatic carboxylic acids. When these basic substances are available, the heat treatment creates a suitable medium in the light-sensitive layer and adjacent layers to ensure that the diffusible dyes will be released from the dye releasing compounds and transferred to the image receptor sheet.

Other auxiliary substances include, for example, compounds which are capable of releasing water under the action of heat. These include in particular inorganic salts which contain water of crystallisation, e.g. $Na_2SO_4.10H_2O$; $NH_4Fe(SO_4)_2.12H_2O$ and compounds of the type of sodium benzotriazolate which in the form of their complexes crystallize with varying quantities of water (up to 24 mol $H_2O$); compounds of this kind are described in US-A-4 418 139.

The water released on heating assists the development and diffusion processes required for production of the image.

Other essential auxiliary substances for the purpose of the present invention are the TTDA described above. These compounds need not necessarily be present in the same layer as that which contains the light-sensitive silver halide and the dye releasing compound. It is sufficient if any layer of binder which is in contact with the light-sensitive layers during the heat treatment contains the required quantity of TTDA. When heated, the TEDM creates a suitable solubilizing medium promoting the development and dye diffusion processes, at least in those layers which are involved in the processes of development and dye diffusion. The TTDA according to the invention may therefore be present in a light-sensitive layer containing the silver halide and a colour providing compound or in a light-insensitive layer of binder or in several of the aforesaid layers. It may also be contained in an image receptor layer which is situated on the same layer support as the light-sensitive layers and which together with these layers forms part of an integral recording material. The TDDA may also be contained in an image receptor layer of a separate image receptor material, provided contact is established with the light-sensitive layers of the heat developable photographic recording material during the heat treatment.

Lastly, the TDDA according to the invention may be present in a dispersed form in an auxiliary sheet which is brought into contact with the light-sensitive recording material and is subjected to a heat treatment together with this material. A process of this kind is described, for example, in DE-A-3 523 361.

Without departing from the scope of the invention, the TDDA according to the invention may also be used in combination with one or more of the so-called thermal solvents known in the art, such as those described, for example, in DE-A-3 339 810, EP-A-0 119 615 and EP-A-0 122 512.

Development of the imagewise exposed colour photographic recording material according to the invention covers the partial steps of silver halide development, production of an imagewise distribution of diffusible dyes and transfer of this imagewise distribution into the image receptor layer by diffusion. This development is initiated by subjecting the exposed recording material to a heat treatment in which the light-sensitive layer of binder is heated to a temperature e.g. in the region of 80° to 250° C. for about 0.5 to 300 seconds. This heat treatment creates suitable conditions in the recording material for the development processes including the process of dye diffusion without the aid of a liquid medium such as a developer bath. In the process of development, diffusible dyes are released imagewise from the dye releasing compounds and transferred to an image receptor layer which is either an integral component of the colour photographic recording material according to the invention or is in contact with this material at least during the time of development. Imagewise development of silver, release of dye and transfer of dye thus take place synchronously in a single-step development process.

Production of the colour image with the colour photographic recording material according to the invention may also be carried out by a two-stage development process in which silver halide development and release of dye take place in the first stage and transfer of the colour image from the light-sensitive part to an image receptor part in contact therewith is carried out in the second stage, e.g. by heating to a temperature in the region of 50° to 150° C., preferably 70° to 90° C. In this case, diffusion auxiliaries (solvents) may be applied externally before the light-sensitive part and the image receptor part are laminated together.

The image receptor layer may therefore be arranged either on the same layer support as the light-sensitive element (single sheet material) or on a separate layer support (two-sheet material). The layer consists essentially of a binder containing mordant for fixing the diffusible dyes released from the non-diffusible dye releasing compounds. The mordants used for anionic dyes are preferably long chained quaternary ammonium or phosphonium compounds, e.g. those described in US-A-3 271 147 and US-A-3 271 148.

Certain metal salts and their hydroxides which form sparingly soluble compounds with acid dyes may also be employed. Polymeric mordants such as those described in DE-A-2 315 304, DE-A-2 631 521 or DE-A-2 941 818 may also be used. The dye mordants are dispersed in the mordant layer in one of the usual hydrophilic binders, e.g. in gelatine, polyvinyl pyrrolidone or partially or completely hydrolysed cellulose esters. Some binders may, of course, also function as mordants, e.g. the polymers of nitrogen-containing, optionally quaternary bases such as N-methyl-4-vinylpyridine, 4-vinylpyridine or 1-vinylimidazole, which are described, for example, in US-A-2 484 430. Further examples of suitable mordanting binders include guanyl hydrazone derivatives of alkyl vinyl ketone polymers as described, for example, in US-A-2 882 156 and guanyl hydrazone derivatives of acyl styrene polymers as described, for example, in DE-A-2 009 498. The last mentioned mordanting binders would, however, generally be used in combination with other binders, e.g. gelatine.

If the image receptor layer is kept in surface contact with the light-sensitive element after development, the two layers are generally separated by an alkali permeable, light-reflecting layer of binder containing pigment, not only to provide an aesthetically pleasing image background for the transferred positive colour image but also to provide an optical separation between the negative and the positive. If the image receptor layer is arranged between the layer support and the light-sensitive element and is separated from the latter by a preformed light-reflecting layer, then the layer support must either be transparent so that the transferred colour image can be viewed through this support or the light-sensitive element together with the light-reflecting layer must be removed from the image receptor layer to reveal the latter. On the other hand, the image receptor layer may be arranged as the uppermost layer of an integral colour photographic recording material, in which case exposure is preferably carried out through the transparent layer support.

EXAMPLE 1

A light-sensitive element of a heat developable photographic recording material according to this invention was prepared by applying the following layers in succession to a transparent support of polyethylene terephthalate 175 μm in thickness. The quantities given are based on 1 $m^2$.

Layer 1

A layer containing a green-sensitized silver halide emulsion composed of 0.5 g of silver nitrate containing 4 mol-% of chloride, 88.7 mol-% of bromide and 7.3 mol-% of iodide and having a grain diameter of 0.3 μm, silver benzotriazolate having a silver nitrate content of 0.5 g, and 0.3 g of dye releasing compound A emulsified in 0.15 g of diethyllauramide, and 1.5 g of gelatine.

Layer 2

A layer consisting of 1 g of guanidinium trichloroacetate, 0.03 g of wetting agent B, 0.24 g of 4-methyl-4-hydroxy-methylphenidone, 0.06 g of sodium sulphite, 1.5 g of gelatine and 0.25 g or 0.5 g or 1.0 g, respectively, of compound TDDA-1 according to the invention.

Layer 3

A hardening layer consisting of 0.5 g of gelatine and 0.15 g of the hardener CAS Reg.-No. 65 411-60-1.

The light-sensitive element prepared as indicated above will be referred to as Material 1. Additional Materials 2 and 3 were prepared, which differed from Material 1 in that Compound TTDA-1 according to the invention was used in different quantities in Layer 2,namely Material 2: 0.5 g Material 3: 1.0 g.

Another Material 4 was prepared as comparison material which was composed of the layers indicated above but contained no TDDA in layer 2.

Preparation of an image receptor element

An image receptor element was prepared by the application of the following layers to a layer support of polyethylene laminated paper. The quantities are based on 1 $m^2$.

Layer 1

A layer of mordant consisting of 2 g of polyurethane mordant obtained from 4,4'-diphenylmethane-diisocyanate and N-ethyl-diethanolamine quaternized with epichlorohydrin (according to DE-A-2 631 521, Example of preparation 1), 0.035 g of wetting agent B and 2 g of gelatine.

Layer 2

A hardening layer consisting of 0.8 g of gelatine and 0.5 g of the hardener mentioned above.

Processing

After exposure of the light-sensitive element (Materials 1–4) through a step wedge, the material was processed in two stages. In the first stage of the process, the light-sensitive element was treated at a temperature of 115° C. for 60 seconds. This was carried out by means of a hot plate on which the material was covered with another plate. In the second stage of the process, the image receptor element which had been immersed in water was laminated to the previously heat treated light-sensitive element and the resulting set was treated with application of pressure to a temperature of 70° C. for 2 minutes as in the first stage of the process. During this time, dye was transferred from the light-sensitive element to the image receptor element. The two layer elements were then separated. A magenta coloured negative image of the exposure original was found on the image receptor element.

The results of development of Materials 1–4 are summarized in Table 1. The minimum and maximum colour densities measured behind green filters are entered in the Table.

TABLE 1

| Material | TDDA-1 g/$m^2$ | Colour transfer D min | / | D max |
|---|---|---|---|---|
| 1 | 0.25 | 0.13 | | 0.65 |
| 2 | 0.50 | 0.15 | | 1.20 |
| 3 | 1.00 | 0.33 | | 2.33 |
| 4 | — | 0.15 | | 0.50 |

Table 1 shows that when Compound TDDA-1 according to the invention is added, a marked increase in density is obtained compared with that obtained without the addition of this compound but the minimum densities are not increased in the same proportion.

We claim:

1. Heat development process for the production of colour images in which an imagewise exposed colour photographic recording material having at least one layer of binder arranged on a layer support and containing light-sensitive silver halide, optionally in combination with a substantially light-insensitive silver salt, and at least one non-diffusible, colour providing compound which is capable of releasing a diffusible dye as a result of development is developed by heat treatment in the presence of a thermal development and diffusion promoting agent, the dye released imagewise from the non-diffusible, colour providing compound being transferred to an image receptor layer capable of absorbing diffusible dyes, characterised in that the thermal development and diffusion-promoting agent corresponds to the following formula I

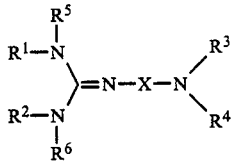

(I)

wherein

X denotes $SO_2$;

$R^1$ to $R^4$ denote alkyl, cycloalkyl, aralkyl or aryl;

$R^5$ and $R^6$ denote acyl or a group as defined for $R^1$ to $R^4$; and $R^1$ together with $R^5$; $R^2$ together with $R^6$; $R^3$ together with $R^4$; and/or $R^1$ together with $R^2$ may in each case form a heterocyclic ring containing at least one nitrogen atom.

2. Process according to claim 1, characterised in that in formula I, the two substituents in each pair $R^1$ and $R^2$; $R^3$ and $R^4$; $R^5$ and $R^6$ are identical.

3. Process according to claim 1, characterised in that in formula I the substituents $R^1$ to $R^6$ are alkyl groups with up to 4 carbon atoms.

4. Process according to one of the claims 1, 2 or 3, characterised in that the thermal development and diffusion-promoting agent is contained in the colour photographic recording material and/or in a separate image receptor material which is in contact with the colour photographic recording material during the heat treatment.

5. Colour photographic recording material developable by heat treatment, having at least one layer of binder which is arranged on a layer support and contains light-sensitive silver halide, optionally in combination with a substantially light-insensitive silver salt, at least one non-diffusible, colour providing compound which is capable of releasing a diffusible dye as a result of development by heat treatment, and at least one thermal development and diffusion promoting agent, characterised in that the thermal development and diffusion promoting agent corresponds to the following formula I:

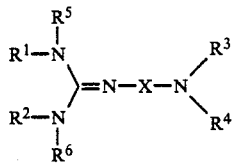

(I)

wherein

X denotes $SO_2$;

$R^1$–$R^4$ denote alkyl, cycloalkyl, aralkyl or aryl;

$R^5$ and $R^6$ denote acyl or a group as defined for $R^1$–$R^4$; and $R^1$ together with $R^5$; $R^2$ together with $R^6$; $R^3$ together with $R^4$; and/or $R^1$ together with $R^2$ may in each case form a heterocyclic ring containing at least one nitrogen atom.

6. Recording material according to claim 5, characterised in that in formula I, the two members in each pair of substituents $R^1$ and $R^2$; $R^3$ and $R^4$; and $R^5$ and $R^6$ are identical.

7. Recording material according to claim 5, characterised in that in formula I, the substituents $R^1$ to $R^6$ are alkyl groups with up to 4 carbon atoms.

* * * * *